US007556317B2

(12) United States Patent
Bottemiller

(10) Patent No.: US 7,556,317 B2
(45) Date of Patent: Jul. 7, 2009

(54) METHOD OF TENSIONING FABRIC AND FURNITURE CONSTRUCTION

(75) Inventor: Donald L. Bottemiller, Wadena, MN (US)

(73) Assignee: Homecrest Outdoor Living LLC, Fargo, ND (US)

( * ) Notice: Subject to any disclaimer, the term of this patent is extended or adjusted under 35 U.S.C. 154(b) by 762 days.

(21) Appl. No.: 10/834,294

(22) Filed: Apr. 28, 2004

(65) Prior Publication Data

US 2005/0264081 A1 Dec. 1, 2005

(51) Int. Cl.
*A47C 7/00* (2006.01)
*B68G 7/00* (2006.01)

(52) U.S. Cl. ..... 297/440.11; 297/284.2; 29/91.5; 29/448

(58) Field of Classification Search ..... 29/428, 29/91.1, 91.5, 448, 452, 897.31; 297/284.2, 297/440.11
See application file for complete search history.

(56) References Cited

U.S. PATENT DOCUMENTS 4,456,301 A 6/1984 Apissomian ..... 297/445
4,592,126 A 6/1986 Bottemiller ..... 29/446
5,716,101 A * 2/1998 Frinier et al. ..... 297/440.22
6,311,570 B1 * 11/2001 Niedermuhlbichler . 73/862.392
6,341,822 B2 1/2002 Apissomian ..... 297/440.11
6,345,428 B2 2/2002 Apissomian ..... 29/428
6,623,079 B2 * 9/2003 Gregory ..... 297/440.11
6,767,066 B1 * 7/2004 Tornero ..... 297/440.11

* cited by examiner

*Primary Examiner*—Anthony D Barfield
(74) *Attorney, Agent, or Firm*—Z. Peter Sawicki; Westman, Champlin & Kelly, P.A.

(57) ABSTRACT

A furniture construction and a method of placing a section of fabric in tension on the furniture construction includes providing a pair of rigid members each having a slot extending along one side. A rigid edge portion is provided on opposite sides of the section of fabric. Each rigid edge portion is then inserted into the slot of each rigid member such that the fabric overlies an adjacent side surface of each rigid member. The rigid members are then moved in opposing directions thereby place the fabric in tension. The edge portion of the fabric is sufficiently rigid to retain the fabric within the slot and thereby retain the fabric in tension. The rigid members are then secured to the furniture construction.

15 Claims, 4 Drawing Sheets

METHOD OF TENSIONING FABRIC AND FURNITURE CONSTRUCTION

BACKGROUND OF THE INVENTION

The present invention relates to furniture construction, in particular, it relates to tensioning fabric in furniture construction.

Furniture having strips of flexible material or entire sheets of flexible material stretched over a framework are popular. Some methods of stretching flexible sheets of material over chair frames are described in U.S. Pat. Nos. 4,371,142, 4,456,301, 4,592,126, 6,341,822 and 6,345,482.

SUMMARY OF THE INVENTION

The present invention includes a furniture construction and a method of placing a section of fabric in tension on the furniture construction. The section of fabric is placed in tension between two spaced apart rigid members, each of the rigid members having a slot extending along one side. A sufficiently rigid edge portion is provided on opposite sides of the section of fabric. Each sufficiently rigid edge portion is then inserted into the slot of each rigid member such that the fabric overlies an adjacent side surface of each rigid member. The edge portion of the fabric is sufficiently rigid to retain the fabric within the slot. The rigid members are then moved in opposing directions thereby placing the fabric in tension. The rigid members are then secured to the furniture construction.

DETAILED DESCRIPTION

Figure 1:
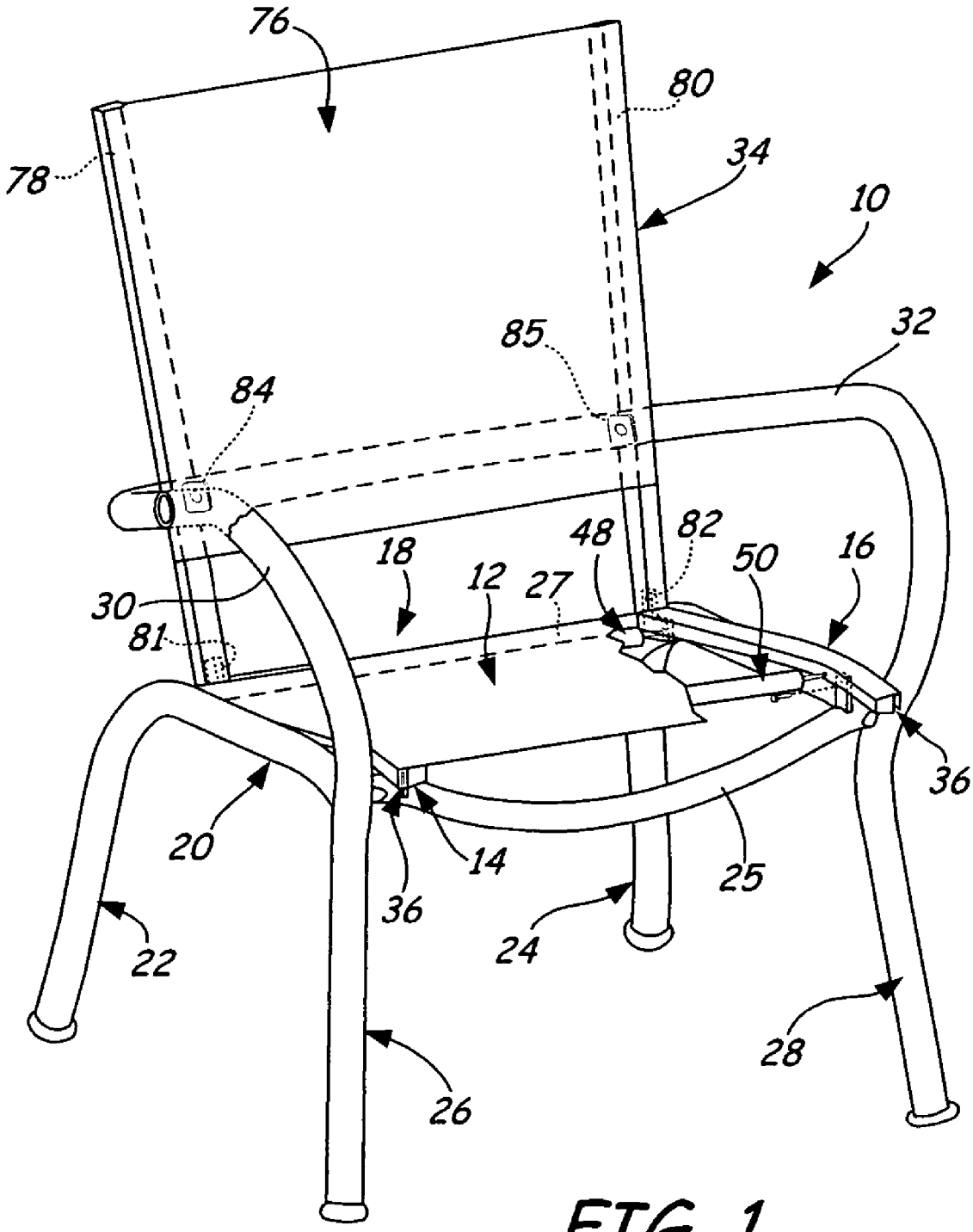
FIG. 1 is perspective view of the present invention.

A chair construction of the present invention is generally indicated at 10 in FIG. 1. Like reference characters will be used to indicate like elements in the drawings. Although a chair construction is specifically illustrated, it is understood that the present invention is applicable to other furniture constructions. The present invention also includes a method of placing a section of fabric 12 in tension between two rigid seat members 14 and 16. As specifically illustrated, the section of fabric 12 and the rigid seat members 14 and 16 form a seat portion 18 of the chair construction 10. The method of the present invention is also used to form a back portion 34 of the chair construction. Although a single seat chair is illustrated, the method of the present invention may be used for chairs providing for more than single occupancy or which have more than one seat and back portion.

The chair construction 10 includes a framework 20 that can be made of plastic, aluminum or steel. The framework includes legs 22, 24, 26 and 28. A front crossbrace 25 and a rear crossbrace 27 extend between and connect the legs 26 and 28 and the legs 22 and 24, respectively. In the embodiment illustrated, the legs 26 and 28 have upper portions 30 and 32 which serve as arms and which are integrally conjoined behind the back portion 34. The particular construction of the framework 20 is not especially important to the present invention, and is described herein as one exemplary type of framework for which the present invention is suitable.

Figure 2:
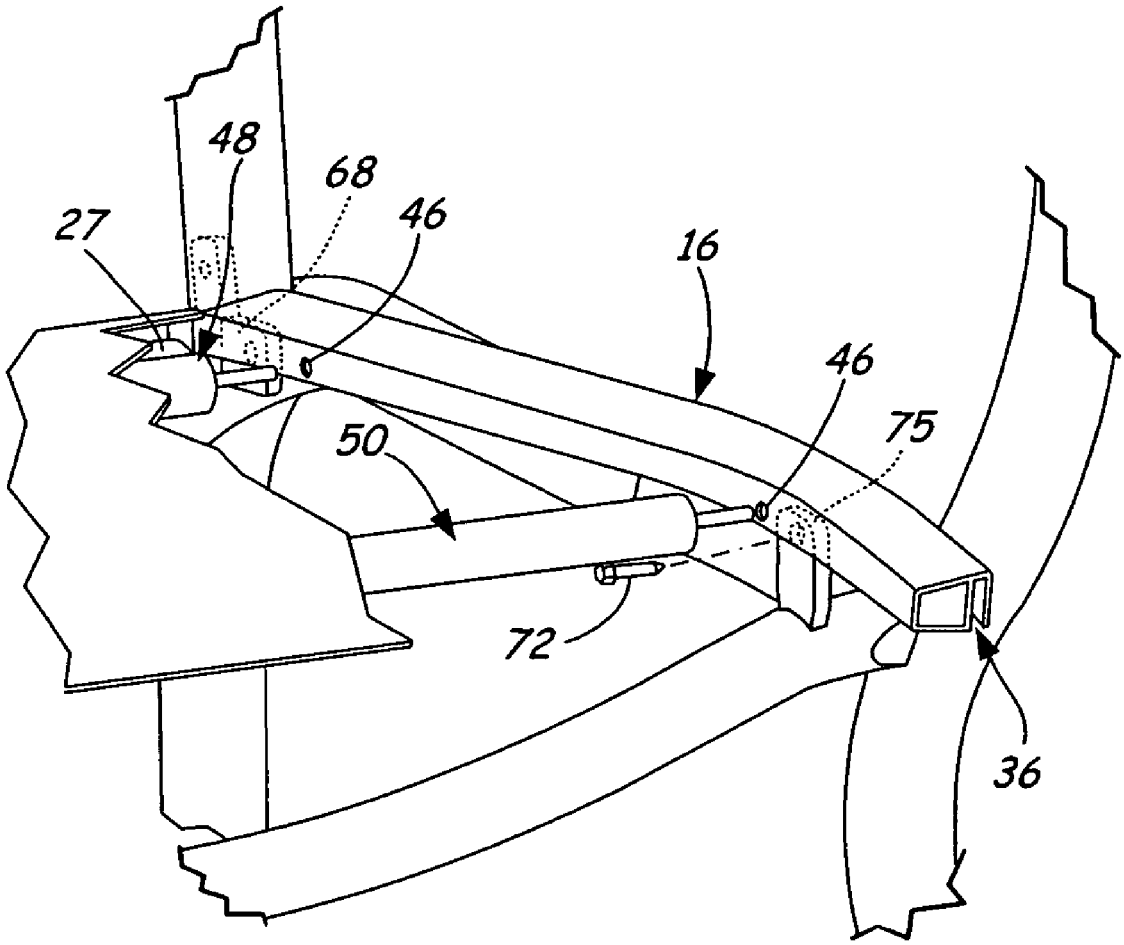
FIG. 2 is an enlarged perspective view of a portion of the chair construction illustrated in FIG. 1.
Figure 3A:
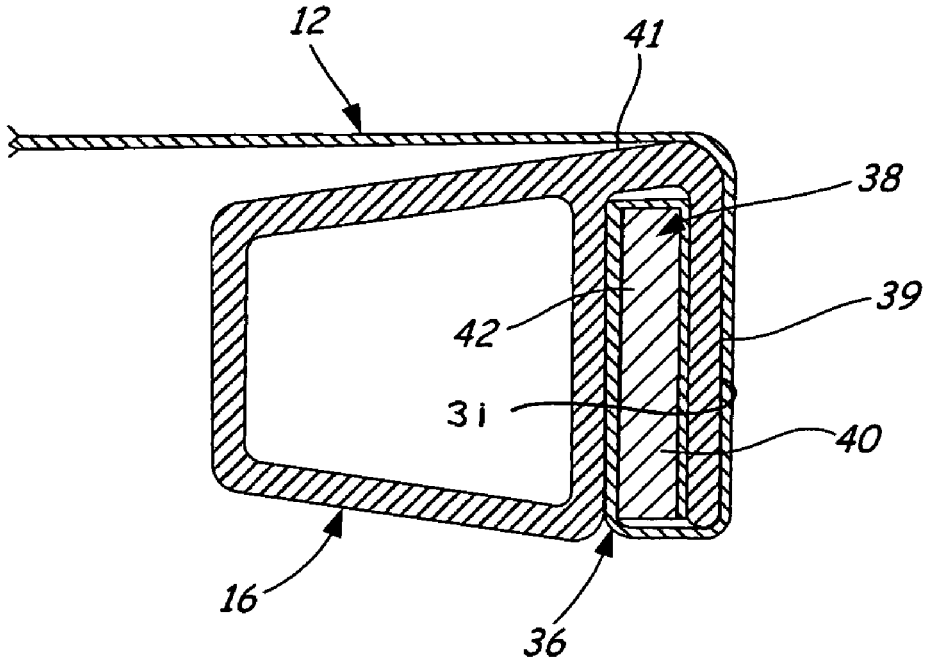
FIG. 3 is a sectional view of rigid member with fabric attached thereto.
Figure 3B:
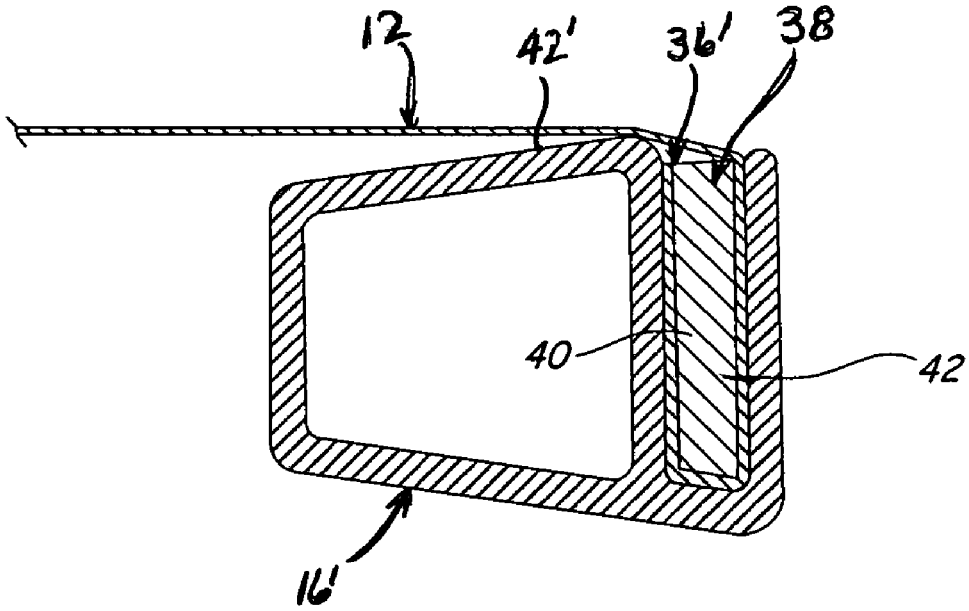

To form the seat portion 18, the rigid seat members 14 and 16 are provided with a downwardly facing slot 36 as best illustrated in FIGS. 2 and 3. The slot 36 runs the length of the rigid members. The section of fabric 12 includes a semi-rigid or rigid edge portion 38 that extends along the length of opposing edge portions. The fabric section 12 overlies the seat member 16 along an outwardly facing side 31 adjacent to the slot 36 and extends over an upwardly facing side 41, as illustrated in FIG. 3. Although only the seat member 16 is specifically illustrated in FIG. 3, the seat member 14 is similar as a mirror image in both construction and how the fabric section 12 overlies the seat member 14.

The semi-rigid or rigid edge portion 38 is sufficiently rigid to secure the section of fabric 12 to the seat member 16 by engagement with the slot 36. Preferably, the edge portion 38 is made of a section of plastic 40 that is attached to an edge portion 42 of the section of fabric 12 by a method that is well known. For example, such rigid edge portions are provided to canvas tops for Jeep Wrangler vehicles made by Chrysler-Daimler to secure the canvas in certain places along the vehicle by engaging selectively positioned slots. It should be understood that other constructions and methods are included within the present invention to make the edge portion 38 sufficiently rigid to secure the fabric to either seat member 14 or 16. By sufficiently rigid is meant that once the edge portion is positioned within the slot and the fabric is placed along the adjacent side 31, the edge portion is retained within the slot since the edge portion cannot slide out due to its rigidity.

The section of fabric 12 is made of a stretch fabric woven from an all-weather, vinyl-coated, flexible and elastic polyester yarn, such as PHIFERTEX® fabric made by Phifer Wire Products, Inc. of Tuscaloosa, Ala. An example of a stretchable fabric useful in this invention is described in U.S. patent application Ser. No. 10/369,444, entitled Chair Seat With Firm But Resilient Front Edge, filed on Feb. 19, 2003, which is herein incorporated by reference in its entirety.

Figure 4:
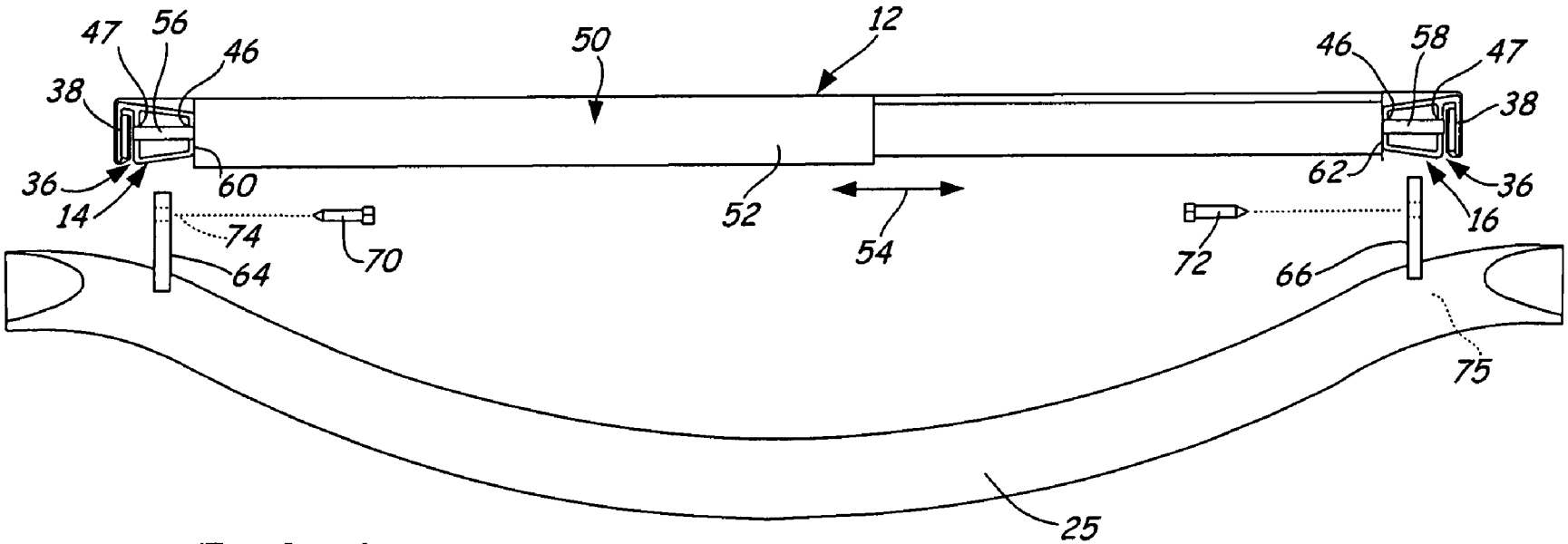
FIG. 4 is a plan view illustrating a method of placing the fabric section in tension.

The section of fabric 12 of the seat portion 18 is placed in tension by initially inserting the rigid edge portions 38 into the slots 36 of the rigid seat members 14 and 16. In one example of the method of construction of the present invention, rigid seat members 14 and 16 each have two sets of apertures 46 and 47 with one set of aperture positioned near the front crossbrace and one set of apertures positioned near the rear crossbrace, as best illustrated in FIGS. 2 and 4.

The apertures 46 and 47 are engaged by spreader tools 48 and 50. Referring to FIG. 4, the spreader tool 50 is illustrated with respect to the fabric 12, and in relation to the front crossbrace 25. Both spreader tools 48 and 50 are essentially the same, and therefore only spreader tool 50 will be described. The spreader tool 50 includes a pneumatic or hydraulic cylinder 52 which provides a force to move the seat members 14 and 16 in the direction of arrows 54. The spreader tool 50 at each end includes pins 56 and 58 which engage apertures 46 and 47 of the rigid seat members 14 and 16, respectively. Each pin 56 and 58 engages both the apertures 46 and 47 to prevent the seat members 14 and 16 from rotating about their axis when the section of fabric is placed in tension. Both spreader tools 48 and 50 are used to move the seat members 14 and 16 away from each other to place the section of fabric 12 in tension.

To retain the seat members 14 and 16 in position on the frame 20, the front crossbrace 25 includes retainer tabs 64 and 66. Similarly, the rear crossbrace 27 includes similar retainer tabs, only one of which is shown (68). The retainer tabs of the front and rear crossbraces are positioned from each other at a distance which matches a selected distance which seat members 14 and 16 are to be spread apart for the selected tension of the section of fabric 12.

The spreader tools 48 and 50 spread the seat members 14 and 16 sufficiently far enough so that inside faces 60 and 62 of the seat members 14 and 16 extend beyond the retaining tabs 64 and 66. The retaining tabs are preferably permanently secured to the respective crossbraces such as by welding.

Once the seat members 14 and 16 are positioned beyond the retaining tabs of the front and rear crossbraces, the spreader tools 48 and 50 may be drawn in and the pins disengaged from apertures 46 and 47. Just prior to the disengagement of the spreader tools or directly thereafter, the seat members 14 and 16 are secured to the retaining tabs by screws 70 and 72 which extend through apertures 74 and 75 and into the seat members 14 and 16. The seat members 14 and 16 are similarly attached to the retaining tabs of the rear crossbrace 27. The screws 70 and 72 are exemplary of fasteners that may be used to secure the seat members 14 and 16 in position. Other fasteners or other fastening systems such as adhesives or welding are included within the present invention. Detachable fasteners such as screws have the advantage that the section of fabric may be easily replaced by detaching the seat members 14 and 16 from the frame 20.

The back portion 34 is similarly constructed. The back portion 34 is also made of a section of fabric 76 that is in tension between back rigid members 78 and 80, as best illustrated in FIG. 1. The back members 78 and 80 are similar in construction and have the same cross-section as the seat members 14 and 16 illustrated in FIG. 3. The section of fabric 76 also includes rigid end portions similar to the edge portions of fabric 12 that are placed within the slots of the back members 78 and 80. The section of fabric 76 is also placed into tension in a similar manner using spreader tools 48 and 50. The back members 78 and 80 are spread sufficiently far apart to extend beyond retaining tabs 82 and 80 that extend from the rear crossbrace 27 and retaining tabs 84 and 85 which extend from arm sections 30 and 32 that extend behind the back portion 34 of the chair. The retaining tabs are preferably fixedly attached to the crossbrace and arm sections such as by welding.

Once the back members 78 and 80 are moved beyond the retaining tabs 81, 84 and 82, 85, the back members 78 and 80 are attached to the retaining tabs, and the spreader tools are disengaged from the back members 78 and 80. Screws (not illustrated) are used in the same manner as screws 70 and 72 to attach the back members 78 and 80 to the retaining tabs 81, 82, 84 and 85.

Although the present invention has been described with reference to preferred embodiments, workers skilled in the art will recognize that changes may be made in form and detail without departing from the spirit and scope of the invention.

What is claimed is:

1. A method of placing a section of fabric in tension on a furniture construction, the section of fabric being placed in tension between two spaced apart rigid members, each rigid member having a slot extending along one side thereof, the method comprising:

providing a rigid edge portion on opposing sides of the section of fabric;

inserting the rigid edge portion of each opposing side into the slot of each rigid member such that a portion of the section of fabric overlies an adjacent surface of the rigid member and the rigid edge portion being sufficiently rigid such that the rigid edge portion is held within the slot;

moving the rigid members in opposing directions by spreader tools which engage the rigid members to move the rigid members in opposing directions thereby placing the section of fabric in tension; and securing the rigid members to the furniture construction while the section of fabric is in tension.

2. The method of claim 1 wherein the furniture construction includes spaced apart tabs extending therefrom and wherein the rigid members are moved in opposing directions a sufficient distance to engage outer surfaces of the tabs and securing the rigid members to the tabs.

3. The method of claim 1 wherein the spreader tools are hydraulic or pneumatic cylinders and have pins on opposing ends, the pins engaging apertures in the rigid members.

4. A method of constructing a chair, the method comprising:

constructing a framework having four ground engaging legs;

providing a seat section of fabric having a rigid edge portion on opposing sides of the section of fabric;

providing a pair of rigid seat members each having a slot extending along the length thereof;

inserting rigid edge portions of the seat section of fabric into the slots such that the fabric overlies a side of the rigid seat members adjacent to the slot;

moving the rigid seat members in opposing directions by spreader tools which engage the rigid seat members to move the rigid seat members in opposing directions thereby placing the seat section of fabric in tension; and securing the rigid seat members to the framework while the seat section of fabric is in tension thereby forming a seat of the chair.

5. The method of claim 4 wherein framework includes a first two sets of spaced apart tabs extending therefrom and wherein the rigid seat members are moved in opposing directions a sufficient distance to engage outer surfaces of the tabs and securing the rigid seat members to the tabs.

6. The method of claim 4 wherein the spreader tools are hydraulic or pneumatic cylinders and have pins on opposing ends, the pins engaging apertures in the rigid seat members.

7. The method of claim 4 and further comprising:

providing a pair of rigid back members, each rigid back member having a slot along the length thereof;

providing a back section of fabric, the back section of fabric having opposing rigid edge portions;

inserting the rigid edge portion of the back section of fabric into the slots of the rigid back members;

moving the rigid back members in opposing directions thereby placing the back section of fabric in tension; and securing the rigid back members to the framework in a substantially vertical position while the back section of fabric is in tension thereby forming a back portion of the chair.

8. The method of claim 7 wherein the framework includes a second two sets of spaced apart tabs extending therefrom and wherein the rigid back members are moved in opposing directions a sufficient distance to engage outer surfaces of the tabs and securing the rigid back members to the tabs.

9. The method of claim 7 wherein the rigid back members are moved in opposing directions by spreader tools which engage the rigid back members to move the rigid back members in opposing directions.

10. The method of claim 9 wherein the spreader tools are hydraulic or pneumatic cylinders and have pins on opposing ends, the pins engaging apertures in the rigid back members.

11. A method of constructing a chair, the method comprising:

constructing a framework having four ground engaging legs;

providing a seat section of fabric having a rigid edge portion on opposing sides of the section of fabric;

providing a pair of rigid seat members each having a slot extending along the length thereof;

inserting rigid edge portions of the seat section of fabric into the slots such that the fabric overlies a side of the rigid seat members adjacent to the slot;

moving the rigid seat members in opposing directions by spreader tools which engage the rigid back members to move the rigid back members in opposing directions thereby placing the seat section of fabric in tension; and securing the rigid seat members to the framework while the seat section of fabric is in tension thereby forming a seat of the chair.

12. The method of claim 11 wherein framework includes a first two sets of spaced apart tabs extending therefrom and wherein the rigid seat members are moved in opposing directions a sufficient distance to engage outer surfaces of the tabs and securing the rigid seat members to the tabs.

13. The method of claim 11 and further comprising:

providing a pair of rigid back members, each rigid back member having a slot along the length thereof;

providing a back section of fabric, the back section of fabric having opposing rigid edge portions;

inserting the rigid edge portion of the back section of fabric into the slots of the rigid back members;

moving the rigid back members in opposing directions thereby placing the back section of fabric in tension; and securing the rigid back members to the framework in a substantially vertical position while the back section of fabric is in tension thereby forming a back portion of the chair.

14. The method of claim 13 wherein the framework includes a second two sets of spaced apart tabs extending therefrom and wherein the rigid back members are moved in opposing directions a sufficient distance to engage outer surfaces of the tabs and securing the rigid back members to the tabs.

15. The method of claim 11 wherein the spreader tools are hydraulic or pneumatic cylinders and have pins on opposing ends, the pins engaging apertures in the rigid back members.

* * * * *